US008598789B2

(12) United States Patent
Haacke et al.

(10) Patent No.: US 8,598,789 B2
(45) Date of Patent: Dec. 3, 2013

(54) DISCHARGE LAMP WITH IMPROVED DISCHARGE VESSEL

(75) Inventors: Michael Haacke, Aachen (DE); Ralf Muckel, Aachen (DE); Wilfried Emunds, Alsdorf (DE); Manfred Westemeyer, Aldenhoven (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/062,274

(22) PCT Filed: Sep. 7, 2009

(86) PCT No.: PCT/IB2009/053891

§ 371 (c)(1), (2), (4) Date: Mar. 4, 2011

(87) PCT Pub. No.: WO2010/029487

PCT Pub. Date: Mar. 18, 2010

(65) Prior Publication Data

US 2011/0156582 A1 Jun. 30, 2011

(30) Foreign Application Priority Data

Sep. 10, 2008 (EP) ..... 08105291

(51) Int. Cl.
*H01J 61/18* (2006.01)
*H01J 9/38* (2006.01)

(52) U.S. Cl.
USPC ..... 313/638; 313/623; 313/637; 445/26

(58) Field of Classification Search
USPC ..... 313/637–638, 643, 630, 623; 445/26, 445/40
See application file for complete search history.

(56) References Cited

U.S. PATENT DOCUMENTS

| | | | | |
|---|---|---|---|---|
| 4,594,529 | A | 6/1986 | de Vrijer | |
| 4,935,668 | A * | 6/1990 | Hansler et al. | 315/82 |
| 6,495,962 | B2 | 12/2002 | Uemura et al. | |
| 6,639,341 | B1 | 10/2003 | Sakai et al. | |
| 7,098,596 | B2 | 8/2006 | Takagaki et al. | |
| 2003/0102805 | A1 * | 6/2003 | Hataoka et al. | 313/623 |
| 2003/0222584 | A1 | 12/2003 | Deguchi et al. | |
| 2007/0108913 | A1 | 5/2007 | Gunther et al. | |
| 2007/0182332 | A1 | 8/2007 | Haacke et al. | |
| 2009/0224674 | A1 * | 9/2009 | Selezneva et al. | 313/623 |

FOREIGN PATENT DOCUMENTS

| | | | |
|---|---|---|---|
| JP | 2007172959 | A | 7/2007 |
| WO | 2008102300 | A1 | 8/2008 |

* cited by examiner

*Primary Examiner* — Anh Mai
*Assistant Examiner* — Elmito Breval

(57) ABSTRACT

A high pressure gas discharge lamp has electrodes that project into a discharge space surrounded by a discharge wall. The discharge space has a filling of rare gas and metal halides. The metal halide composition comprises halides of sodium and scandium with a mass ratio of halides of Sodium and Scandium of 0.9-1.5. In order to provide a lamp that can be easily manufactured and is well suited for operation at reduced power, the discharge vessel wall is of externally and internally cylindrical shape. The lamp may be manufactured by providing a cylindrical tube of quartz material, heating the tube at two distant portions and forming grooves there, inserting two electrodes into the tube and heating and pinching the tube at both ends to seal the discharge space. Manufacture is carried out without a bulb forming step such that the discharge space remains in externally and internally cylindrical shape.

20 Claims, 5 Drawing Sheets

DISCHARGE LAMP WITH IMPROVED DISCHARGE VESSEL

FIELD OF THE INVENTION

The present invention relates to a high-pressure gas discharge lamp, in particular for use in automotive front lighting.

BACKGROUND OF THE INVENTION

Discharge lamps, specifically HID (high-intensity discharge) lamps are used for a large area of applications where high light intensity is required. Especially in the automotive field, HID lamps are used as vehicle headlamps.

A discharge lamp comprises a sealed discharge vessel, which may be made e.g. from quartz glass, with an inner discharge space. Two electrodes project into the discharge space, arranged at a distance from each other, to ignite an arc therebetween. The discharge space has a filling comprising a rare gas and further ingredients such as metal halides.

An important aspect today is energy efficiency. The efficiency of a discharge lamp may be measured as lumen output in relation to the electrical power used. In discharge lamps used today for automotive front lighting an efficiency of about 90 lumen per Watt (lm/W) is achieved at a steady state operating power of 35 Watt.

During manufacture of known discharge lamps for automotive applications, it is conventional to use a bulb forming process to obtain a discharge vessel with at least externally ellipsoid shape.

U.S. Pat. No. 4,594,529 discloses a gas discharge lamp with an ionisable filling of rare gas, mercury and metal iodide. A lamp envelope is made of quartz glass and has an elongate discharge space, in which electrodes project. The discharge space of the lamp is circular-cylindrical. In a shown example, the inner diameter is 2.5 mm and the distance between the electrodes 4.5 mm. The lamp envelope has a comparatively thick wall to obtain a homogenous temperature distribution. The described lamp has a filling of Argon and 1 mg of Sodium Iodide, Scandium Iodide and Thorium Iodide in a molar ratio of 94.5:4.4:1.1 and obtains a luminous flux of 2500 lm in operation at a power of 35 W.

SUMMARY OF THE INVENTION

It is an object of the present invention to provide a lamp that can be easily manufactured and that is well suited for operation at reduced power.

According to the invention, there is provided a discharge lamp with a discharge vessel providing an inner discharge space, which is surrounded by a discharge vessel wall made out of quartz material. As conventional, there are at least two electrodes projecting into the discharge space. According to the invention, the discharge vessel wall is, at least in the region between these electrodes, of both externally and internally cylindrical shape.

A corresponding lamp with a cylindrical quartz discharge vessel may be manufactured by starting from a cylindrical tube of the quartz material. At the tube, two grooves are formed defining a discharge space in between the grooves. Electrodes are inserted within the tube to project into the discharge space. The discharge vessel is filled and finally sealed by heating and pinching at both ends.

The above described manufacturing process is carried out without further modification to the shape of the discharge vessel wall. Specifically, there is no bulb forming step, in which the tube portion between the grooves is heated to a softening temperature and then further formed, such as by blowing. Instead, the discharge vessel wall (at least the portion between the electrode tips) remains—both internally and externally—in cylindrical shape.

The discharge space, which preferably has a volume of 12-20 $mm^3$, more preferred 14-18 $mm^3$ is filled with a filling consisting at least of a rare gas—preferably xenon—and a metal halide composition. According to the invention, the filling is at least substantially free of mercury, i.e. with no mercury at all or only unavoidable impurities thereof.

The lamp according to the invention has a metal halide composition carefully chosen to achieve a high lumen output. The composition comprises at least halides of Sodium (Na) and Scandium (Sc), preferably NaI and $ScI_3$. The mass ratio of the halides of Na and Sc is (mass of Na halide)/(mass of Sc halide)=0.9-1.5, preferably 1.0-1.35.

Thus, according to the invention, a discharge vessel wall of quartz material is provided in cylindrical shape. Manufacture of a corresponding discharge vessel has proven to be more simple than prior methods using bulb forming. Also, the cylindrical shape has advantageous optical properties: While prior known discharge vessel walls were usually ellipsoid, which leads to an optical distortion (magnification) effect, the proposed cylindrical discharge vessel produces no such distortion in axial direction. The arc between the electrodes does not optically appear at the outside to be longer than it actually is. Considering that specifications for automotive lamps narrowly define the visible (optical) arc length (usually at 4.2 mm average, with defined admissible tolerances), and that the intensely emitting portions at the ends of the arc are especially important, the lamp according to the invention, which allows a larger actual distance between the electrode tips while still fulfilling given design specifications, is especially advantageous. A larger electrode distance, in turn, has advantageous electrical, optical and thermal properties: The arc voltage will be higher, such that a nominal power of e.g. 25 W is achieved with a lower current. The larger distance allows for better heat transition from the arc to the surrounding discharge vessel wall material, leading to excellent run-up behavior due to quick heating. Especially if the discharge vessel geometry is chosen such that a narrow discharge space (small inner diameter) is obtained, a straightened arc is obtained which is advantageous for projection.

Thus, a lamp according to the invention may be easily manufactured and is well suited for operation at reduced nominal power (e.g. 15-30 W), especially for automotive front lighting.

The lamp according to the invention further has, due to the metal halide composition and the adequately chosen mass ratio of halides therein, a high efficiency at reduced power (15-30 W). It should be recognized that lamp efficiency, i.e. total lumen output achieved in relation to input electrical operating power, for a given lamp design (geometry, filling etc.) strongly depends on the operating power.

The inventors have recognized that simply operating existing lamp designs at lower nominal power will lead to drastically reduced efficiency. For example, a lamp which at 35 W operation has an efficiency of about 90 lm/W has at 25 W only an efficiency of around 62 lm/W. According to a preferred embodiment of the invention, there is thus provided a lamp design aimed at high efficiency for operation at reduced nominal power, namely 25 W.

According to a preferred embodiment of the invention, the proposed lamp has an efficiency which is equal to or greater than 85 lm/W in a steady state operation at an electrical power of 25 W. In the present context, the efficiency measured in lm/W referred to is always measured at a burnt-in lamp, i.e.

after the discharge lamp has been first started and operated for 45 minutes according to a burn-in sequence. Preferably, the efficiency at 25 W is even 88 lm/W or more, most preferably 95 lm/W or more.

As will become apparent in connection with the preferred embodiments discussed below, there are several measures which may be used to obtain a lamp of high efficiency, such that the above efficiency values are achieved even at a low operating power of preferably 25 W. These measures refer on one hand to the discharge vessel itself, where a small inner diameter and a thin wall help to achieve high efficiency. On the other hand, this refers to the filling within the discharge space, where a relatively high amount of halides, and especially a high amount of the light emitting halides of Sodium and Scandium (as opposed to other halides, such as halides of Zinc (Zn) and Indium (In)) are provided. Further, the high pressure of the rare gas within the discharge space, and measures directed to lower the heat conduction via an outer enclosure serve to provide more lumen output.

In the following, several geometric parameters (wall thickness, inner/outer diameter etc.) of the discharge vessel will be discussed, where each of the parameters are to be measured in a plane central between the electrodes in orthogonal orientation thereto.

The geometric design of the discharge vessel should be chosen according to thermal considerations. The "coldest spot" temperature should be kept high to achieve high efficiency. Generally, the inner diameter of the discharge vessel should be chosen relatively small, e.g. 1.9-2.1 mm. A minimum inner diameter of 1.7 mm is preferred to avoid too close proximity of the arc to the discharge vessel wall. According to a preferred embodiment, the discharge vessel has a maximum inner diameter of 2.4 mm.

The wall thickness of the discharge vessel may preferably be chosen to be 1.0-1.5 mm, so that a relatively small discharge vessel is provided, which has a reduced heat radiation and is therefore kept hot even at lower electrical powers.

Regarding the filling of the discharge space, the metal halide composition may be provided preferably in a concentration of 6-19 μg/μl of the volume of the discharge space. However, to achieve a high lumen output it is preferred to use at least 9 μg/μl. According to a further preferred embodiment, the metal halide concentration is 9-12.5 μg/μl to achieve a high lumen output and good lumen maintenance.

Generally, the metal halide composition may comprise further halides besides halides of Sodium and Scandium. It is generally possible to further use halides of Zinc and Indium. However, these halides do not substantially contribute to the lumen output, so that according to a preferred embodiment the metal halide composition comprises at least 90 wt % halides of Scandium and Sodium. Further preferred, the metal halide composition comprises even more than 95% halides of Sodium and Scandium. In an especially preferred embodiment, the metal halide composition consists entirely of NaI and $ScI_3$ and does not comprise further halides. In an alternative embodiment, the metal halide composition consists of NaI, $ScI_3$ and a small addition of a thorium halide, preferably $ThI_4$. Thorium halide serves to lower the work function of the electrodes.

The rare gas provided in the discharge space is preferably Xenon. The rare gas may be provided at a cold (20° C.) filling pressure of 10-18 bar. Most preferably and especially preferred in connection with a halide composition that does not substantially comprise halides of Zinc and Indium, it is preferred to use a relatively high gas pressure of 10-20 bar, more preferred 13-17 bar. Such a high pressure provides high lumen output and at the same time may lead to a relatively high burning voltage, which may be in the range of 40-55 V, although the metal halide composition consists of only NaI and $ScI_3$ as well as (optionally) $ThI_4$.

As a further measure to provide high efficiency, the lamp comprises an outer enclosure provided around the discharge vessel. The outer enclosure is preferably also made of quartz glass. The enclosure is sealed to the outside and filled with a gas, which may be provided at atmospheric or reduced pressure (pressure below 1 bar). The outer enclosure serves as insulation to keep the discharge vessel at a relatively high operation temperature, despite the reduced electrical power.

The outer enclosure may be of any geometry, e.g. cylindrical, generally elliptical or other. It is preferred for the outer enclosure to have an outer diameter of at most 10 mm.

In order to reduce the heat flow from the discharge vessel, the outer enclosure is provided at a certain distance therefrom. For the purposes of measurement, the distance discussed here is measured in cross-section of the lamp taken at a central position between the electrodes. The gas filling of the outer enclosure is chosen, together with the distance and the pressure, such that a desired heat transition coefficient $$\frac{\lambda}{d_2}$$

is achieved. Preferred values for $$\frac{\lambda}{d_2}$$

are 6.5-226 W/(m$^2$K), further preferred are 34-113 W/(m$^2$K). Preferably, the outer enclosure is arranged at a distance of 0.3-2.15 mm, preferably 0.6-2 mm to the discharge vessel.

According to a preferred embodiment, the gas filling of the outer enclosure is at a pressure of 10-700 mbar. The gas filling is preferably at least one out of or a mixture of Argon, Xenon or air.

In a preferred embodiment, the electrodes are rod-shaped with a diameter of 150-300 μm. On one hand, the electrodes should be provided thick enough to sustain the necessary run-up current. On the other hand, electrodes for a lamp design with high efficiency at relatively low steady state power need to be thin enough to still be able to operate in steady state at low power and to heat the discharge vessel sufficiently. For a lamp design of 25 W nominal power a preferred value for the diameter is 230-270 μm.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

All embodiments shown are intended to be used as automotive lamps for vehicle head lights, conforming to ECE R99 and ECE R98. This, specifically, is not intended to exclude lamps for non-automotive use, or lamps according to other regulations. Since such automotive high pressure gas discharge lamps are known per se, the following description of the preferred embodiments will primarily focus on the special features of the invention.

Figure 1:
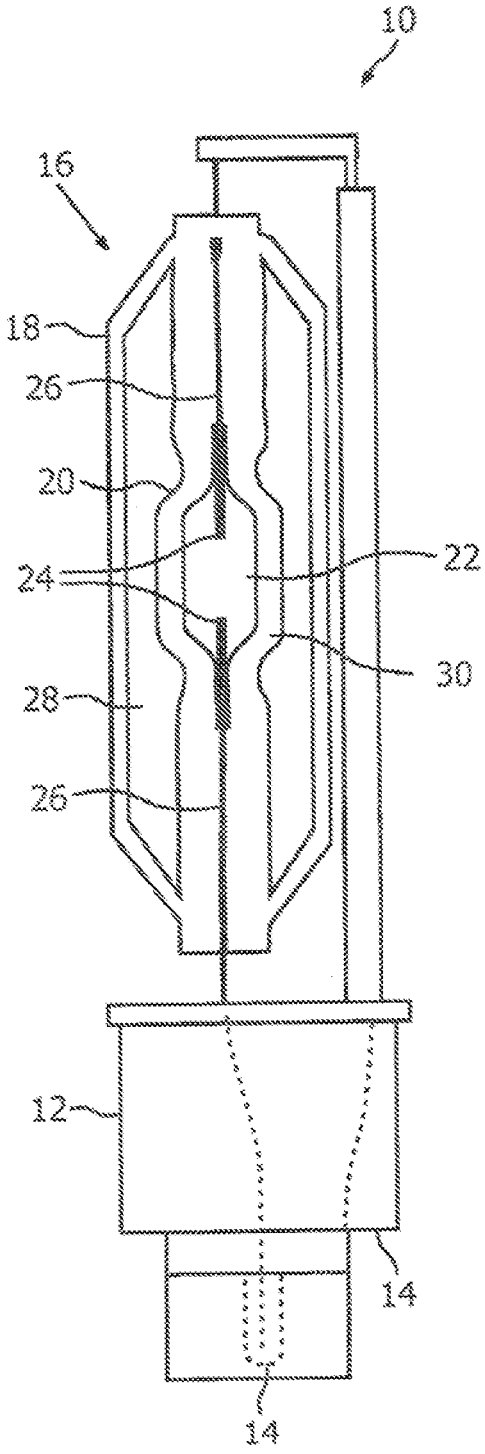
FIG. 1 shows a side view of a lamp according to an embodiment of the invention.

FIG. 1 shows a side view of a first embodiment 10 of a discharge lamp. The lamp comprises a base 12 with two electrical contacts 14 which are internally connected to a burner 16.

The burner 16 is comprised of an outer enclosure (in the following referred to as outer bulb) 18 of quartz glass surrounding a discharge vessel 20. The discharge vessel 20 is also made of quartz glass and defines an inner discharge space 22 with projecting, rod-shaped electrodes 24. The glass material from the discharge vessel further extends in longitudinal direction of the lamp 10 to seal the electrical connections to the electrodes 24 which comprise flat molybdenum foils 26.

The outer bulb 18 is, in its central portion, of cylindrical shape and arranged around the discharge vessel 20 at a distance, thus defining an outer bulb space 28. The outer bulb space 28 is sealed.

Figure 2:
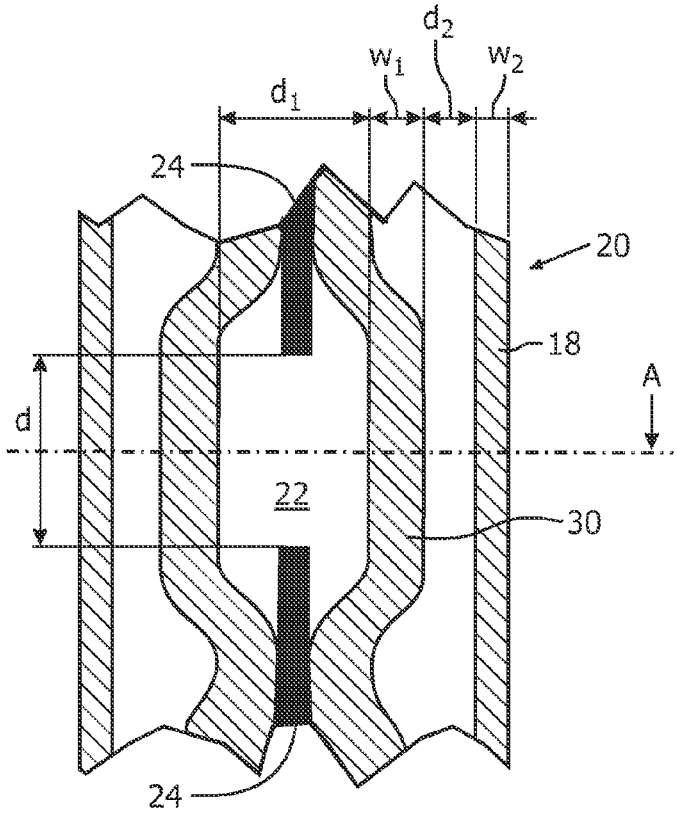
FIG. 2 shows an enlarged view of a central portion of the lamp shown in FIG. 1.

As shown in greater detail in FIG. 2, the discharge vessel 20 has a discharge vessel wall 30 arranged around the discharge space 22. The inner and outer shape of the wall 30 is cylindrical. The discharge space 22 is thus of cylindrical shape. It should be noted that the cylindrical shape is present at least in the central, largest part of the discharge space 22 between the electrodes 24 which does not exclude—as shown—differently shaped, e.g. conical end portions.

In its central part, the wall 30 surrounding the discharge space 22 is consequently of essentially constant thickness $w_1$.

Figure 2A:
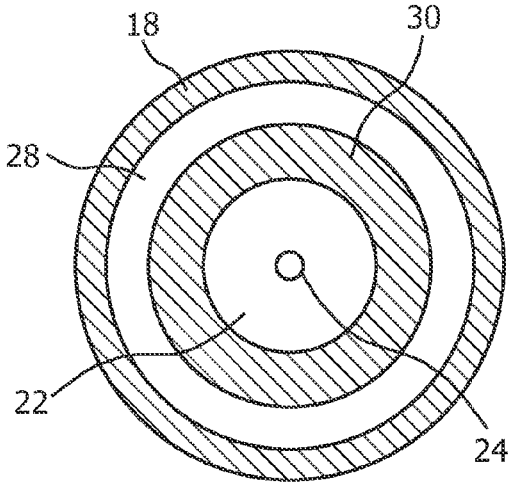
FIG. 2*a* shows a cross-sectional view along the line A in FIG. 2.

The discharge vessel 20 is characterized by the electrode distance d, the inner diameter $d_1$ of the discharge vessel 20, the wall thickness $w_1$ of the discharge vessel, the distance $d_2$ between the discharge vessel 20 and the outer bulb 18 and the wall thickness $w_2$ of the outer bulb 18. Here, the values $d_1$, $w_1$, $d_2$, $w_2$ are measured in a central perpendicular plane of the discharge vessel 20, as shown in FIG. 2*a*.

The lamp 10 is operated, as conventional for a discharge lamp, by igniting an arc discharge between the electrodes 24. Light generation is influenced by the filling comprised within the discharge space 22, which is free of mercury and includes metal halides as well as a rare gas.

Due to the cylindrical shape of the discharge vessel wall 30, the arc ignited between the electrodes 24 optically appears from the outside at the same length that it actually has, i.e. there is no optical distortion (magnification) effect caused by the cylindrical discharge vessel wall 30. Thus, for an externally observed optical electrode distance of 4.2 mm (ECE R 99), the electrode tips may be in fact positioned 4.2 mm apart (in contrast to ellipsoid discharge vessels, where—depending on the curvature—it may be necessary to provide an electrode distance of only 3.8 mm to obtain an external optical distance of 4.2 mm). Since the burning voltage of a discharge lamp varies generally linearly in dependence on the electrode distance, the lamp with a cylindrical discharge vessel may thus obtain a 8% higher burning voltage, so that in order to obtain the same operating power, e.g. 25 W, an approximately 8% lower current is needed.

The enlarged electrode distance also provides for good thermal behavior of the lamp during run-up. Thermal power will, due to the increased burning voltage, be higher and the increased distance d insures a rapid heating of the discharge vessel wall 30. The thin discharge vessel 20 has a relatively low quartz mass, so that it may heat up rapidly.

Further, the enlarged electrode distance together with the relatively narrow discharge vessel (the internal diameter $d_1$ is chosen quite small, e.g. at 2.0 mm as will be discussed below) the arc between the tips of the electrodes 24 will have a relatively straight shape, which is advantageous for projection of the light generated by the lamp in a reflector.

Regarding the thermal behavior of a discharge lamp 10 as shown, it should be kept in mind that automotive lamps are intended to be operated horizontally. The arc discharge between the electrode 24 will then lead to a hot spot at the wall 30 of the discharge vessel 20 above the arc. Likewise, opposed portions of the wall 30 surrounding the discharge space 22 will remain at comparatively low temperatures (coldest spot).

In order to reduce heat transport from the discharge vessel 20 to the outside, and to maintain high temperatures necessary for good efficacy, it is thus preferable to provide the outer bulb 18 to reduce heat conduction. In order to limit cooling from the outside, the outer bulb 18 is sealed and filled with a filling gas. The outer bulb filling may be provided at reduced pressure (measured in the cold state of the lamp at 20° C.) of less than 1 bar. As will be further explained below, the choice of a suitable filling gas should be made in connection with the geometric arrangement in order to achieve the desired heat conduction from discharge vessel 20 to outer bulb 18 via a suitable heat transition coefficient $\lambda/d_2$.

The heat conduction to the outside may be roughly characterized by a heat transition coefficient $\lambda/d_2$, which is calculated as the thermal conductivity $\lambda$ of the outer bulb (which in the present context is always measured at a temperature of 800° C.) filling divided by the distance $d_2$ between the discharge vessel 20 and the outer bulb 18.

Due to the relatively small distance between the discharge vessel 20 and outer bulb 18, heat conduction between the two is essentially diffusive and will therefore be calculated as $\dot{q}=-\lambda \text{ grad } \theta$, where $\dot{q}$ is the heat flux density, i.e. the amount of heat transported per time between discharge vessel and outer bulb. $\lambda$ is the thermal conductivity and grad $\theta$ is the temperature gradient, which here may roughly be calculated as the temperature difference between discharge vessel and outer bulb, divided by the distance:

$$grad\vartheta = \frac{T_{dischargeVessel} - T_{outerBulb}}{d_2}.$$

Thus, cooling is proportional to $$\frac{\lambda}{d_2}.$$

In connection with the embodiments proposed in the present context, different types of filling gas, different values of filling pressure and different distance values $d_2$ may be chosen to obtain a desired transition coefficient $$\frac{\lambda}{d_2}.$$

The filling pressure may be atmospheric or reduced (i.e. below 1 bar, preferably below 700 mbar, but above 12 mbar). However, it has been found that the heat transition coefficient changes only little with the pressure.

The filling may be any suitable gas, chosen by its thermal conductivity value λ (measured at 800° C.). The following table gives examples of values for λ (at 800° C.):

| | |
|---|---|
| Neon | 0.120 W/(mK) |
| Oxygen | 0.076 W/(mK) |
| Air | 0.068 W/(mK) |
| Nitrogen | 0.066 W/(mK) |
| Argon | 0.045 W/(mK) |
| Xenon | 0.014 W/(mK) |

Possible distances $d_2$ between the discharge vessel wall 30 and the outer bulb 18 may range e.g. from 0.3 mm to 2.15 mm, preferably from 0.6 mm to 2 mm. A high value of $d_2$ may be obtained by a narrow discharge vessel (small $d_1$) with thin walls (small $w_1$) and a relatively large outer bulb 18.

To obtain good insulation, especially Argon, Xenon, air or a mixture thereof is preferred as filling gas. However, since the heat transition coefficient is of course dependent on distance $d_2$, different gas fillings may also be chosen with a high enough $d_2$.

Preferred values for $$\frac{\lambda}{d_2}$$

range from 6.5 W/(m$^2$K) (achieved e.g. by a Xenon filling at a large distance of $d_2$=2.15 mm) to 226 W/(m$^2$K) (achieved e.g. by an air filling at a small distance of $d_2$=0.3 mm). Preferred is a value for $d_2$ of 0.6 mm to 2 mm and an air filling, such that $$\frac{\lambda}{d_2}$$

is 34 W/(m$^2$K) (achieved e.g. by an air filling at $d_2$ of 2 mm) to 113 W/(m$^2$K) (achieved e.g. by an air filling at $d_2$ of 0.6 mm).

The discharge vessel 20 may be manufactured in steps illustrated in FIG. 3*a*-3*f* by starting from a cylindrical tube 2 of quartz material.

Figure 3A:
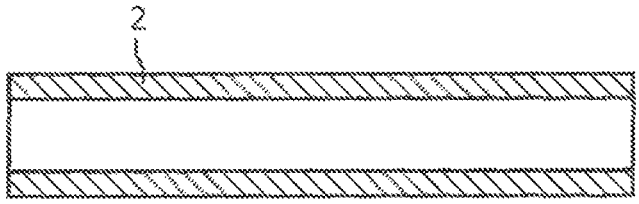
FIG. 3*a-f* show side views of manufacturing stages of a discharge vessel of a lamp according to FIG. 1.
Figure 3B:
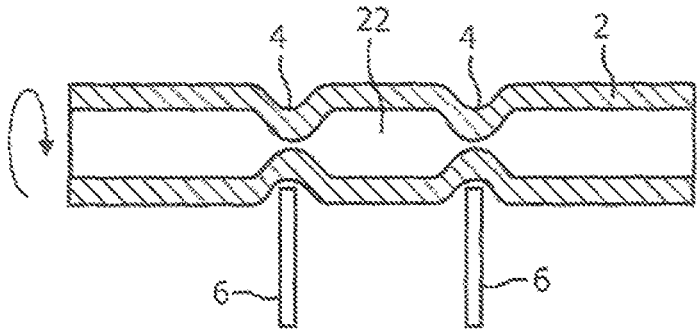

Grooves 4 are provided at two positions at the tube 2 to define a discharge space 22 in between. The grooves 4 are introduced into the tube 2 by heating the quartz glass to a softening temperature and turning the tube 2 while being held against grooving knifes 6 (FIG. 3*b*).

The grooves 4 provide narrow portions of the tube 2, but do not yet seal the discharge space 22.

Figure 3C:
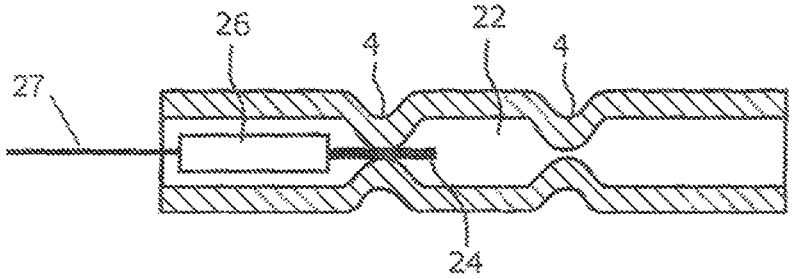

Next, a first of two electrode assemblies is introduced into the tube 2 from one end. Each electrode assembly has a rod-shaped electrode 24 connected to a molybdenum foil 26, which in turn is connected to a contact lead 27. The electrodes 24 are centred by the grooves 4 and project into the discharge space 22 (FIG. 3*c*).

Figure 3D:
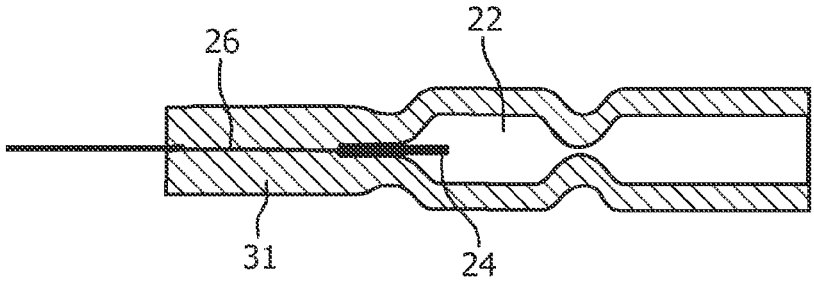
Figure 3E:
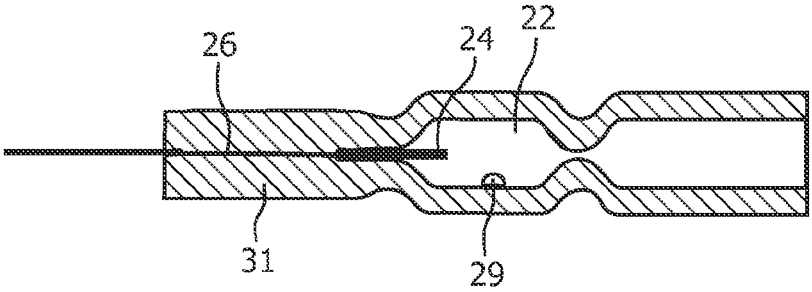

The discharge vessel 20 is sealed at one end by heating the quartz material to a softening temperature and crimping it in the region of the molybdenum foil 26 to produce a first pinch sealed region 31 (FIG. 3*d*).

Figure 3F:
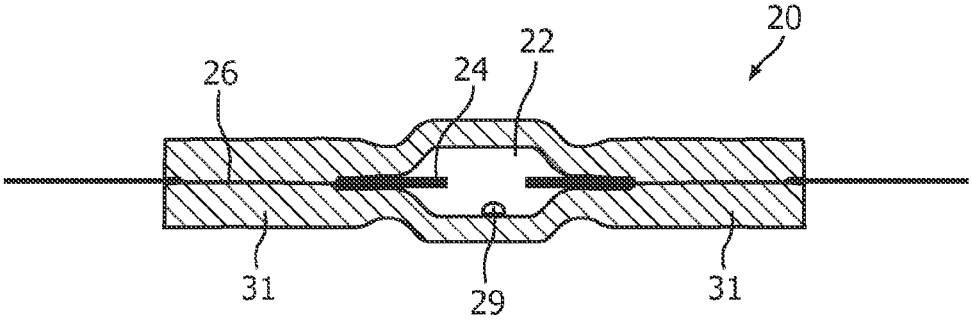

Then, a filling is introduced into the discharge space 22 comprising a metal halide composition 29 and xenon as a rare gas (FIG. 3*e*), before sealing the discharge vessel 20 off from the other end also by producing a second pinch sealed region 31 there (FIG. 3*f*).

Finally, the outer bulb 18 is manufactured by providing a quartz tube of appropriate dimensions around the discharge vessel 20, heating the ends thereof and sealing them to the discharge vessel 20 by rolling. The outer bulb may be filled through a laser hole which is then sealed.

It should be noted that the thus manufactured discharge vessel 20 in its central region between the electrode tips still has the original cylindrical shape of the glass tube 2.

To be able to propose lamp designs with overall high lumen efficiency, the inventors have studied factors contributing to arc efficiency. The following parameters may be adjusted accordingly to obtain a higher efficiency:

Discharge Space Filling:

amount of metal halides: By raising the total amount of strongly light emitting halides, specifically of Sodium and Scandium, the arc efficiency ii is raised.

metal halide composition:

By raising the amount of strongly light emitting halides, such as halides of Natrium and Scandium, in contrast to secondary halides, such as halides of Zinc and Indium, the arc efficiency is raised. Optimally, the metal halide composition only consists of halides of Sodium and Scandium In a metal halide composition with halides of Sodium and Scandium, the arc efficiency η is raised by choosing the mass ratio of Sodium halides and Scandium halides close to an about optimal value of 1.0.

Rare gas pressure: By raising the pressure of the rare gas, preferably Xenon, the arc efficiency is raised.

Thermal Measures Raising "Coldest Spot" Temperature

If the discharge vessel is made smaller, the "coldest spot" temperature is raised, contributing to a high efficiency η. A smaller inner diameter of the discharge vessel may thus lead to a higher efficiency η.

A reduced outer diameter, which may be achieved by a reduced wall thickness, reduces heat radiation, thus raises the "coldest spot" temperature and the efficiency η.

Insulation of the discharge vessel by providing an outer enclosure (outer bulb) to obtain a desired, low heat transition coefficient $$\frac{\lambda}{d_2}:$$

By providing the outer bulb at a greater distance $d_2$ from the discharge vessel, heat transfer is limited and the efficiency consequently raised.

By providing a gas filling in the outer enclosure with low heat conductivity λ, such as Argon, and even further preferred Xenon, the transfer may be further reduced.

Accordingly, by changing the above given parameters it is possible to suitably adjust the arc efficiency η to a desired value.

However, research conducted by the inventors has revealed a surprising fact: While the individual measures, and also combinations thereof, were effective to raise the efficiency up to a certain point, this only serves to raise the efficiency up to a maximum value, where even substantial variations of the above parameters do not substantially yield a further improved efficiency. Surprisingly, this maximum value, as determined in measurements by the inventors, is about constant and not substantially dependent on the individual parameters, i.e. the maximum value $\eta_{max}$ will be the same, regardless of the combination of parameters by which the efficiency is raised.

The inventors currently propose that the reason for this surprising effect is, that by raising the coldest spot temperature the partial pressures of the species in the gas phase are raised, but this raising of the partial pressures also leads to an increased self-absorption of radiation.

This effect may be used to advantage when choosing the appropriate parameters for the lamp 10. It should be kept in mind that the above given parameters, if adjusted only to achieve a high efficiency, will have negative side effects with regard to other requirements of a lamp. A rare gas filling pressure which is too high will negatively influence the lifetime of the lamp, which is why the current invention proposes to limit the Xenon pressure within the discharge space 22 to at most 20 bar. Also, the inner diameter d1, and the wall thickness w1 should not be chosen too small to avoid excessive (mechanical and thermal) wall loads. The same is true for the heat conductivity of the outer bulb 18, as given by the filling pressure, filling gas and distance $d_2$ of the outer bulb 18, which should not be chosen too small to avoid excessively high thermal load. Other restraints to be considered are color and electrical properties such as burning voltage and EMI behavior.

The above described surprising effect now allows a lamp designer to choose the above parameters to achieve the desired high lumen output, but also to limit further optimization in order not to incur unnecessary negative effects. In essence, an optimal lamp design may be chosen to achieve an arc efficiency $\eta$ just at, or little less than, the experimentally found maximum value. In this region, a very high efficiency, close to the maximum possible, is achieved, without choosing excessive parameter values leading to negative effects such as limited lifetime.

Figure 4:
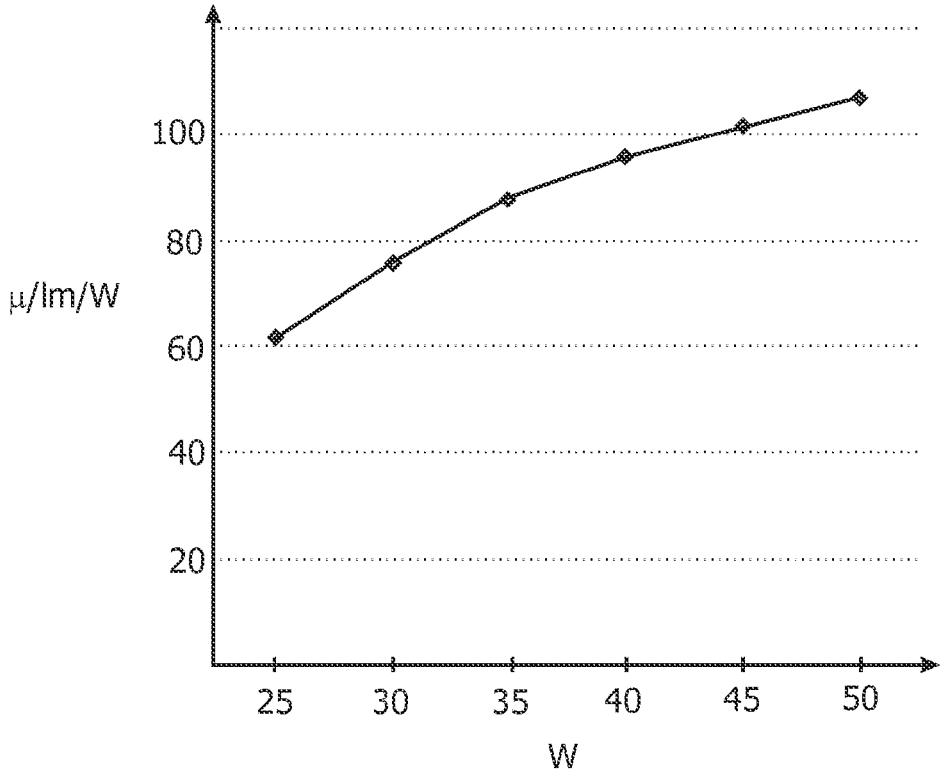
FIG. 4 shows a graph of measured lamp efficiency values over operating power.

It should be kept in mind that lamp efficiency for a certain design is strongly dependent on the operating power. As an example, FIG. 4 shows a graph with different measured values of lamp efficiency (measured after 45 min. burn-in) for a reference design. While the efficiency $\eta$ at 35 W is about 90 lm/W, this value increases up to 107 lm/W achieved at 50 W. However, at lower operating powers, the value decreases. At about 25 W, only an efficiency of 62 lm/W is achieved. Thus, for lamp designs intended to be used at lower operating powers, where lamp efficiency becomes especially important, it is not easy to obtain the desired high efficiency level.

In the following, in accordance with the observations related above, an embodiment of a lamp will be discussed, which is intended to be used at a (steady-state) level of operating power which is lower than prior designs. The nominal operating power of the embodiment is 25 W. The specific design is chosen with regard to thermal characteristics of the lamp in order to achieve high lamp efficacy.

In the preferred example, the discharge vessel and outer bulb are provided as follows:

Example Lamp 1

25 W

| | |
|---|---|
| Discharge vessel: | cylindrical inner shape<br>cylindrical outer shape |
| Electrodes: | rod-shaped |
| Electrode diameter: | 230 μm |

-continued

| | |
|---|---|
| Electrode distance $d_1$: | 4.2 mm optical and real |
| Inner diameter $d_1$: | 2.0 mm |
| Outer diameter $d_1 + 2^* w_1$: | 4.5 mm |
| Discharge vessel volume: | 16 μl |
| Wall thickness $w_1$: | 1.25 mm |
| Outer bulb inner diameter: | 6.7 mm |
| Outer bulb outer diameter: | 8.7 mm |
| Outer bulb wall thickness $w_2$: | 1 mm |
| Outer bulb distance $d_2$: | 1.1 mm |
| Outer bulb filling: | Air |
| Heat transition coeffient: | $\frac{\lambda}{d_2}$ 61.8 W/(m$^2$K), measured at 800° C. |

The filling of the discharge space 22 consists of Xenon and a metal halide composition as follows:

| | |
|---|---|
| Xenon pressure (at 25° C.): | 15 bar |
| Halide composition: | 98 ng NaI, 98 μg $ScI_3$, 4 μg $ThI_4$ |
| Total amount of halides: | 200 μg |
| Amount of halides per mm$^3$ of the discharge space: | 12.5 μg/μl |
| Mass ratio of NaI/$ScI_3$: | 1.0 |

A batch of 10 lamps of the above example was tested and measurements of lumen output were made. After a burn-in sequence of 45 minutes and steady-state operation at 25 W—the lumen output was 2240 lm, corresponding to an efficiency of 89.6 lm/W. After 15 hours of operation at 25 W, the lumen output was 2110 lm, corresponding to an efficiency of 84.4 lm/W.

In the following, variations of the above example are given.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the parameters are chosen differently within the intervals given in the appended claims. The above related observations regarding the effect of a variation of these parameters on lamp efficiency allow to choose the parameters to obtain the desired high efficiency above 90 lm/W, which in the present context is always to be measured at 25 W after a 45 min. burn-in procedure conducted with a horizontally oriented burner which is first started up and operated for 40 min in 180° position (upside down), then turned off and rotated 180° around the longitudinal axis into the final operating 0° position, turned on again and operated for a further 5 min before measurement of the lumen output. It should be noted that due to internal chemical reactions in the discharge vessel the lumen output deteriorates rapidly in the first hours of operation of a discharge lamp. After a burning time of 15 h, typically 5 lm/W of efficiency may already be lost.

Other variations to the disclosed embodiments can be understood and effected by those skilled in the art in practicing the claimed invention, from a study of the drawings, the disclosure, and the appended claims. In the claims, the word "comprising" does not exclude other elements, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A high pressure gas discharge lamp comprising:

a discharge vessel providing a sealed inner discharge space surrounded by a discharge vessel wall made out of quartz material; and at least two electrodes, each projecting into said discharge space, said discharge space comprising a filling of at least a rare gas and a metal halide composition, said filling being substantially free of mercury, wherein said mental halide composition comprises at least halides of Sodium and Scandium, a mass ratio of halides of Sodium and Scandium being 0.9-1.5, said discharge vessel wall is of externally and internally cylindrical shape in the region between said electrodes, and said discharge vessel has an inner diameter of 1.7-2.4 mm and a wall thickness of 1.0-1.5 mm.

2. The discharge lamp according to claim 1, wherein said discharge space has a volume of 12-20 $mm^3$.

3. The discharge lamp according to claim 1, wherein said lamp is configured to have an efficiency equal to or greater than 85 lm/W in a steady state operation at an electrical power of 25 W in a burnt-in state after 45 minutes of operation.

4. The discharge lamp according to claim 1, said lamp further comprising an outer enclosure provided around said discharge vessel, said outer enclosure being sealed and filed with a gas.

5. The discharge lamp according to claim 1, wherein said discharge space comprises 6-19 μg of said metal halide composition per μl of said volume of said discharge space.

6. The discharge lamp according to claim 1, wherein said metal halide composition comprises at least 90 wt % halides of Sodium and Scandium.

7. The discharge lamp according to claim 6, wherein said metal halide composition consists essentially of NaI, $ScI_3$ and $ThI_4$.

8. The discharge lamp according to claim 1, wherein said rare gas in said discharge space is Xenon, provided at a cold pressure of 10-18 bar.

9. A discharge lamp according to claim 1, comprising:

a discharge vessel providing a sealed inner discharge space surrounded by a discharge vessel wall made out of quartz material; and at least two electrodes projecting into said discharge space, said discharge space comprising a filling of at least a rare gas and a metal halide composition, said filling being substantially free of mercury, wherein said metal halide composition comprises at least halides of Sodium and Scandium, a mass ratio of halides of Sodium and Scandium being 0.9-1.5, said discharge vessel wall is, at least in the region between said electrodes, of externally and internally cylindrical shape, and said discharge vessel has an inner diameter of 1.7-2.4 mm and a wall thickness of 1.0-1.5 mm;

wherein said outer enclosure is arranged at a distance and filled with a filling gas such that a heat conduction coefficient $$\frac{\lambda}{d_2},$$

is 6.5-226 W/($m^2$K), wherein λ is the thermal conductivity of the filling gas measured at 800° C. and $d_2$ is the distance between said outer enclosure and said discharge vessel.

10. The discharge lamp according to claim 1, wherein said discharge space comprises 9-12.5 μg of said metal halide composition per μl of said volume of said discharge space.

11. The discharge lamp according to claim 1, wherein said discharge vessel has a wall thickness of 1.2-1.5 mm.

12. The discharge lamp of claim 1, further comprising an outer enclosure around the discharge vessel, wherein the outer enclosure has outer diameter of at most 10 mm and is arranged at a distance of 0.3-2.15 mm to the discharge vessel.

13. The discharge lamp of claim 1, wherein the at least two electrodes extend away from the discharge space passing through respective pinched regions and further regions to an exposed portion for connection to contacts, wherein each of the pinched regions has inner diameter which is smaller than the inner diameter of the discharge vessel and each of the further regions has a same inner diameter as the inner diameter of the discharge vessel.

14. The discharge lamp of claim 13, further comprising an outer enclosure around the discharge vessel, wherein the outer enclosure is sealingly contacts the further regions.

15. A method of manufacturing a high pressure gas discharge lamp, comprising the acts of:

providing a cylindrical tube of quartz material;

heating said tube at at least two distant portions and forming a groove at each of said portions such that a discharge space is defined between said grooves;

inserting at least two electrodes into said tube to project into said discharge space;

filling said discharge space with a filling comprising at least of a rare gas and a metal halide composition, said filling being substantially free of mercury; and heating and pinching said tube to seal said discharge space, said acts being carried out without a bulb forming act such that said discharge space remains in externally and internally cylindrical shape in the region between said electrodes, wherein said discharge vessel has an inner diameter of 1.7-2.4 mm and a wall thickness of 1.0-1.5 mm.

16. The method according to claim 15, wherein said metal halide composition comprises at least halides of Sodium and Scandium, wherein a mass ratio of halides of Sodium and Scandium is 0.9-1.5.

17. The method according to claim 15, further including the act of forming an outer, sealed enclosure around said discharge vessel.

18. The met hod according to claim 15, wherein said discharge vessel has a wall thickness of 1.2-1.5 mm.

19. The method of claim 15, wherein the at least two electrodes extend away from the discharge space passing through respective pinched regions and further regions to an exposed portion for connection to contacts, wherein each of the pinched regions has inner diameter which is smaller than the inner diameter of the discharge vessel and each of the further regions has a same inner diameter as the inner diameter of the discharge vessel.

20. The method of claim 19, further comprising the act of providing an outer enclosure around the discharge vessel, wherein the outer enclosure is sealingly contacts the further regions.

* * * * *